US006293233B1

(12) United States Patent
Hiraoka

(10) Patent No.: US 6,293,233 B1
(45) Date of Patent: Sep. 25, 2001

(54) ENGINE LUBRICATION CONTROL

(75) Inventor: Noriyoshi Hiraoka, Shizuoka (JP)

(73) Assignee: Sanshin Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/421,152

(22) Filed: Oct. 19, 1999

(30) Foreign Application Priority Data

Oct. 19, 1998 (JP) ..... 10-296837

(51) Int. Cl.[7] ..... F01M 3/02
(52) U.S. Cl. ..... 123/73 AD; 123/196 R
(58) Field of Search ..... 123/196 W, 196 R, 123/198 C, 73 AD; 184/6.5, 27.1

(56) References Cited

U.S. PATENT DOCUMENTS 4,411,225 * 10/1983 Dell'orto ..... 123/73 AD
4,615,305 * 10/1986 Matsumoto ..... 123/73 AD
5,934,242 * 8/1999 Anamoto ..... 123/196 R
6,044,822 * 4/2000 Daniels ..... 123/196 R

FOREIGN PATENT DOCUMENTS 4-287817 * 10/1992 (JP) ..... 123/73 AD

* cited by examiner

*Primary Examiner*—Noah P. Kamen
(74) *Attorney, Agent, or Firm*—Knobbe, Martens, Olson & Bear, LLP

(57) ABSTRACT

An engine lubrication control includes an improved construction. The engine has a lubrication device that delivers lubricant to a crankcase of the engine in following rotational speed of a crankshaft rotating in the crankcase. The lubricant device includes an adjustment mechanism for adjusting a volume of the lubricant. The adjustment mechanism has at least two positions and increases the lubricant volume delivered when the mechanism is located at one of the positions relative to when the mechanism is located at the other position.

30 Claims, 11 Drawing Sheets

ENGINE LUBRICATION CONTROL

BACKGROUND OF THE INVENTION

1. Field of the Invention

This invention relates to an engine lubrication control, and more particularly to an improved engine lubrication control that can easily increase lubricant when, for example, breaking-in the engine.

2. Description of Related Art

A conventional outboard motor, in general, employs a two stroke engine. Lubricant usually is mixed with fuel and then supplied to a crankcase of the two stroke engine. When an two stroke engine is first operated, i.e., during a break-in period (e.g., about 10 hours), the engine requires more lubricant than it requires after it is broken-in. More lubricant thus is mixed with the fuel during this initial break-in period of the engine's life.

Some outboard motors equipped with the two stroke engines are now employ a direct fuel injection system, because the system affords many advantages such as improvement of emissions. The direct injection system injects fuel directly into the combustion chamber.

Because the fuel is supplied to the combustion chamber and not through a crankcase chamber in the system, the engine must have a lubrication pump for supplying lubricant to the crankcase chamber separately. The usual way in which lubricant is increased before mixed with fuel as noted above is, therefore, no longer useful during the break-in period of a direct-injection engine.

SUMMARY OF THE INVENTION

Control of the engine's lubrication pump provides a suitable way to increase the amount of lubricant delivered to the engine during the break-in period. If an electric pump is applied to the engine, this control can be accomplished using logic circuitry (e.g., by an ECU of the engine. However, such an electric pump is more costly than a mechanical pump. If a mechanical pump is applied to the engine, a control mechanism can be used to increase lubricant during particular different periods of engine operation (e.g., during the engine's break-in period and afterwards).

In accordance with one aspect of the present invention, an internal combustion engine comprises at least one variable volume combustion chamber. The combustion chamber is defied by at least first and second components which move relative to each other. In one mode, the combustion chamber is defined by a piston that reciprocates within a cylinder bore. A cylinder body defines at least the one cylinder bore, which has a closed end and an open end. The closed end defines, with the piston and the cylinder bore, the combustion chamber. A crankcase adjoins the cylinder body and defines a crankcase chamber with the open end. The crankcase chamber accommodates a crankshaft that is pivotally coupled to the piston and is journaled within the crankcase chamber. A lubrication device delivers varying amounts of lubricant to the crankcase chamber depending upon rotational speed of the crankshaft. The lubrication device also includes an adjustment mechanism to adjust a volume of lubricant delivered to the engine at a particular rotational speed. The adjustment mechanism has at least first and second positions. With the adjustment mechanism in the first position, the lubrication device delivers a first volume of lubricant to the engine at a particular rotational speed. With the adjustment mechanism in the second position, the lubrication device delivers a second larger volume of lubricant to the engine at the same particular rotational speed.

In accordance with another aspect of the present invention, an internal combustion engine comprises at least one variable volume combustion chamber. The combustion chamber is defied by at least first and second components which move relative to each other. In one mode, the combustion chamber is defined by a piston that reciprocates within a cylinder bore. A cylinder body defines at least the one cylinder bore, which has a closed end and an open end. The closed end defines, with the piston and the cylinder bore, the combustion chamber. A crankcase adjoins the cylinder body and defines a crankcase chamber with the open end. The crankcase chamber accommodates a crankshaft, which is pivotally coupled to the piston and is journaled within the crankcase chamber. An air intake system is provided for supplying an air charge to the combustion chamber. The air intake system includes a throttle valve that controls the volume of the air charge delivered to the engine. The rotational speed of the crankshaft increases when the air charge amount increases. The engine further comprises a lubrication pump that delivers lubricant to the crankcase chamber. The lubrication pump includes a rotary member which changes an amount of lubricant flow through the pump when the rotary member is rotated. The lubrication pump also includes a control lever linked with the throttle valve and selectively mounted on the rotary member at least in two positions. The lubrication pump further includes a switchover mechanism for changing the position of the control lever relative to the rotary member.

Further aspects, features and advantages of this invention will become apparent from the detailed description of the preferred embodiments which follow. dr

BRIEF DESCRIPTION OF THE DRAWINGS

These and other features of this invention will now be described with reference to the drawings of preferred embodiments which are intended to illustrate and not to limit the invention.

DETAILED DESCRIPTION OF THE PREFERRED EMBODIMENTS OF THE INVENTION

Figure 1:
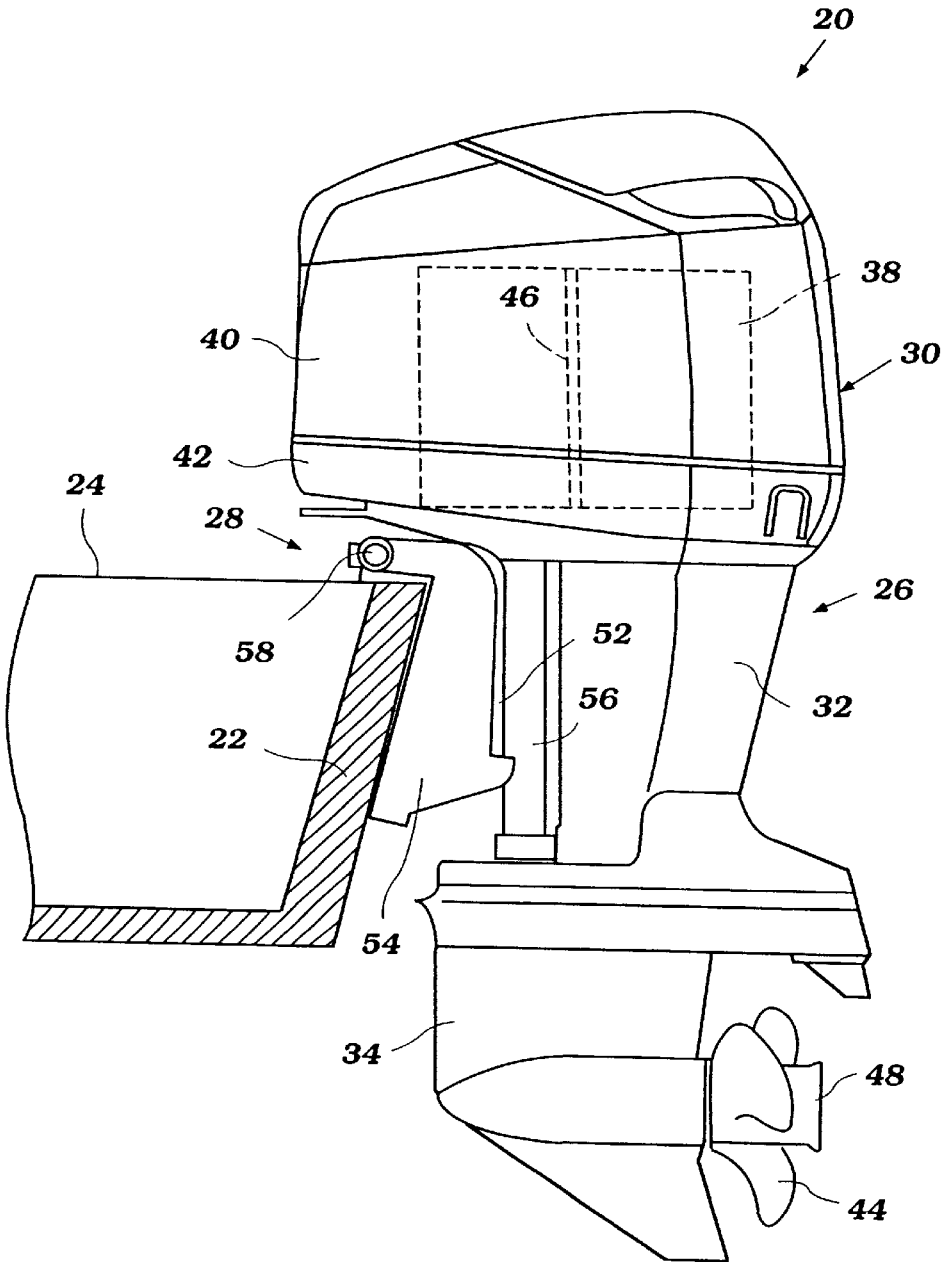
FIG. 1 is a side elevational view showing an outboard motor powered by an engine in accordance with an embodiment of the present invention. An associated watercraft is partially shown in cross-section.

With initial reference to FIGS. 1 through 3, the general overall environment of an exemplary outboard motor and an engine mounted thereon will be described below. Although the invention will be described in conjunction with the engine employed on the outboard motor, it should be readily apparent that the invention can be used with other engines and it is believed that other usage will be readily apparent to those skilled in the art.

An outboard motor 20 is shown as attached to a transom 22 of an associated watercraft 24 (shown partially). The outboard motor 20 generally comprises a drive unit 26 and a bracket assembly 28. The drive unit 26 comprises a power head 30, driveshaft housing 32 and a lower unit 34. The power head 30 is disposed at the top of the drive unit 26 and includes an internal combustion engine 38, a top cowling 40 and a bottom cowling 42. The engine 38 powers a propulsion device such as a propeller 44 disposed at the lowermost portion of the outboard motor 20 and, therefore, has an output shaft or crankshaft 46 extending generally vertically. The engine 38 is shown in more detail in FIGS. 2 and 3 and will be described shortly by reference thereto.

The top and bottom cowlings 40, 42 generally completely encircle the engine 38 so as to protect it. For instance, water is prevented from splashing over the engine 38. The top cowling 40 is detachably affixed to the bottom cowling 42 so as to ensure access to the engine 38 for maintenance.

The driveshaft housing 32 depends from the power head 30 and supports a driveshaft which is driven by the crankshaft 46 of the engine 38. The driveshaft extends generally vertically through the driveshaft housing 32. The driveshaft housing 32 has some sections of an exhaust system through which exhaust gasses flow from the engine 38 and down to the lower unit 34.

The lower unit 34, in turn, depends from the driveshaft housing 32 and supports a propeller shaft which is driven by the driveshaft. The propeller shaft extends generally horizontally through the lower unit 34. The propeller 44 is affixed at the end of the propeller shaft and is driven by the propeller shaft. A bevel gear transmission is provided between the driveshaft and the propeller shaft. The transmission couples together these two shafts which lie generally at a 90 degree shaft angle. The lower unit 34 also includes a discharge section of the exhaust system. Exhaust gasses are finally discharged to the body of water surrounding the outboard motor 20 through a hub 48 of the propeller 44.

The bracket assembly 28 comprises a swivel bracket 52 and a clamping bracket 54. The swivel bracket 52 supports the drive unit 32 for pivotal movement about a generally vertically extending axis, i.e., an axis of a steering shaft. The steering shaft passes through a steering shaft housing section 56 of the swivel bracket 52. The clamping bracket 54, in turn, is affixed to the transom 22 of the associated watercraft 24 and supports the swivel bracket 52 for pivotal movement about a generally horizontally extending axis, i.e., an axis of a tilt shaft 58. A hydraulic tilt cylinder device (not shown) is provided between the swivel bracket 52 and the clamping bracket 54 so that the swivel bracket is lifted up and down relative to the clamping bracket 54. The drive unit 32 is, thus, tilted up and down in a certain range.

The details of the construction of the outboard motor and the components which are not illustrated may be considered to be conventional or of any type known to those wishing to utilize the invention disclosed herein. Those skilled in the art can readily refer to any known construction with which to practice the invention.

Figure 2:
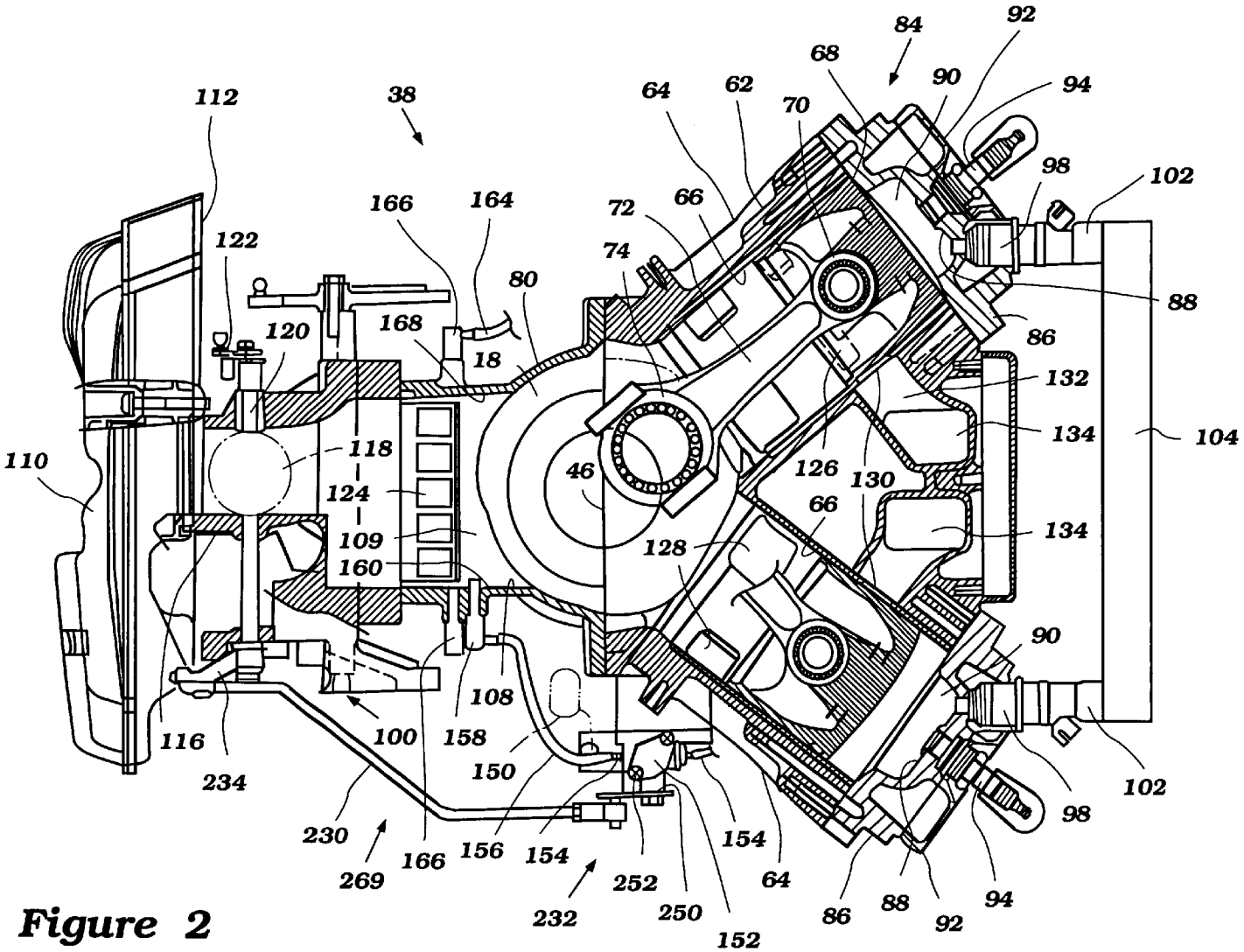
FIG. 2 is an enlarged cross-sectional plan view showing the engine.
Figure 3:
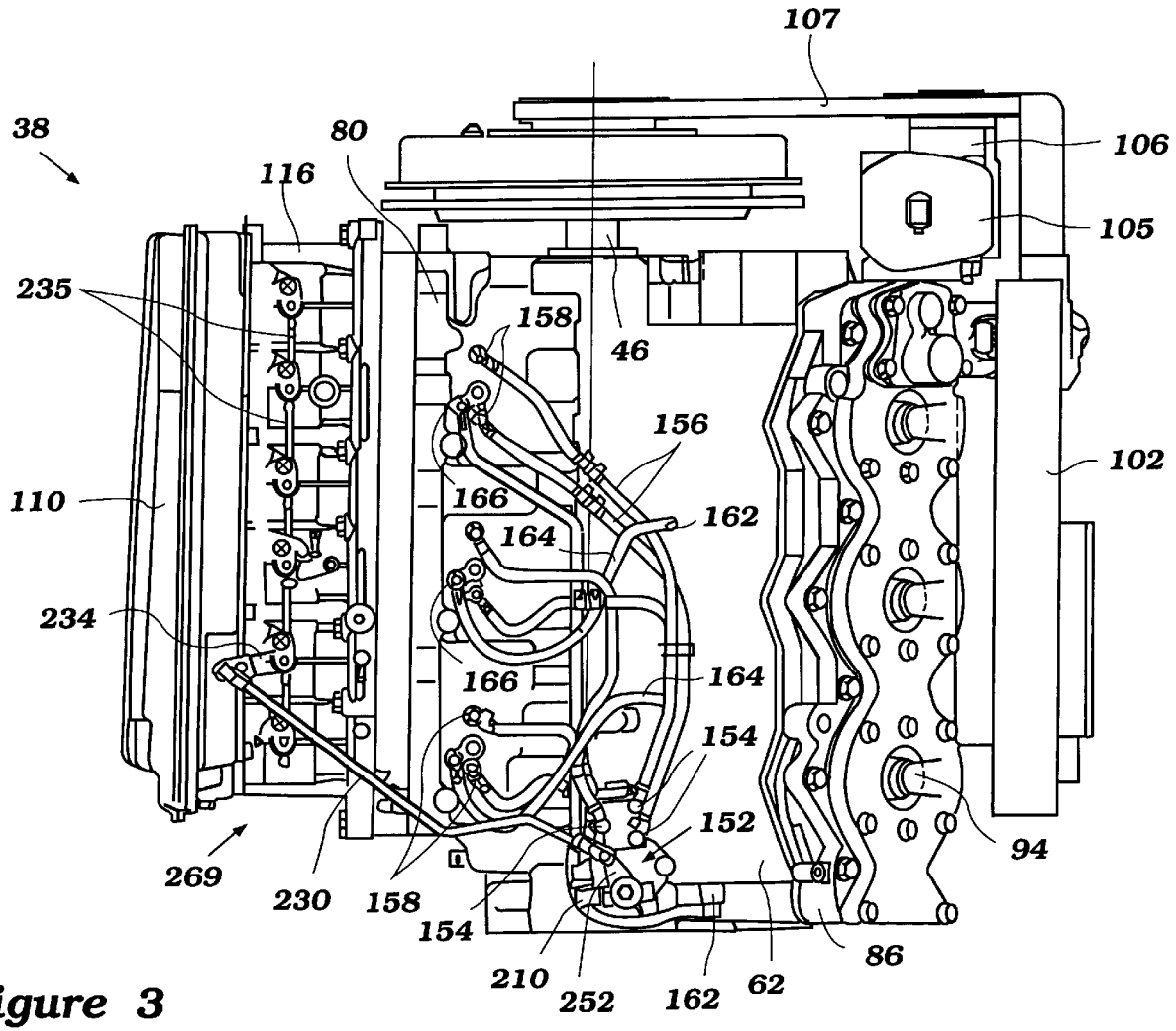
FIG. 3 is an enlarged side elevational view showing the engine.

With reference to FIGS. 2 and 3, a construction of the engine 38 will be described more in detail below. It should be noted that the term "forward" or "forwardly" will mean at or to the side where the clamping bracket 54 is affixed to the transom 22 of the associated watercraft 24 and the term "rear" or "rearwardly" will mean at or to the opposite side of the forward side unless depicted otherwise.

The engine 38 in the illustrated embodiment is of the V6 type and operates on a two stroke, crankcase compression principle. Although the invention is described in conjunction with an engine having this cylinder number and cylinder configuration, it will be readily apparent that the invention can be utilized with engines having other cylinder numbers and other cylinder configurations.

The engine 38 comprises a cylinder block 62 that is formed with a pair of cylinder banks 64. Each of these cylinder banks 64 define three vertically spaced, horizontally extending cylinder bores 66. Although two cylinder bores 66 at the respective banks 64 are shown in the same cross-sectional view schematically in FIG. 2, actually they do not exist at the same level relative to each other vertically. Pistons 68 reciprocate in the cylinder bores 66. The pistons 68 are, in turn, connected to the upper or small ends 70 of connecting rods 72. The big ends 74 of these connecting rods 72 are journaled on throws of the crankshaft 46.

The crankshaft 46 is journaled in a suitable manner for rotation within a crankcase chamber 78 that is formed in part by a crankcase member 80 that is affixed to the cylinder block 62 in a suitable manner. As is typical with two stroke engines, the crankshaft 46 and crankcase chamber 78 are formed with seals so that each section 82 that is associated with one of the cylinder bores 66 will be sealed from the others.

A cylinder head assembly 84 is affixed to the cylinder banks 64 for closing openings of the cylinder block 62 at this end. The assembly of the cylinder head assembly 84 and the cylinder block 62 forms a cylinder body. The cylinder head assembly 84 comprises a cylinder head member 86 that defines a plurality of recesses 88 in its inner face. Each of these recesses 88 corporate with the respective cylinder bore 66 and the head of the piston 68 to define a combustion chamber 90. A cylinder head cover member 92 completes the cylinder head assembly 84.

A spark plug 94 is mounted in the cylinder head assembly 84 for each cylinder bore 66. The spark plugs 94 are fired under control of an electronic control unit (ECU). The spark plugs 94 fire a fuel air charge or mixture of fuel that is sprayed by fuel injectors 98 directly into the combustion chambers 90 and an air charge supplied by an air induction system 100 which will be described shortly.

The fuel injector 98 adjoins the spark plug 94 in each combustion chamber 90 with a certain angle. Respective three fuel injectors 98 at each cylinder bank 64 are connected to a fuel rail 102 extending generally vertically. That is, there are two fuel rails 102 and they, in turn, are connected to a fuel manifold 104 extending generally horizontally. The fuel injectors 98 are electrically operated under the ECU also and provide optimum fuel vaporization under all running conditions because they spray the fuel directly into the combustion chambers 90.

Fuel is supplied to the fuel injectors 98 by a fuel supply system that includes the fuel rails 102 and the fuel manifold 104. A fuel supply tank is placed in the hull of the associated watercraft 24 and fuel is pumped to a vapor separator (not shown) mounted on the engine 38 from the tank and then pressurized by a pumping mechanism including a high pressure fuel pump 105 (see FIG. 3). In the illustrated embodiment, the high pressure fuel pump 105 is mounted on a cylinder block 62 with a pump drive unit 106. The pump drive unit 106 is driven from a driving pulley affixed to the crankshaft 46 by means of a drive belt 107. The fuel is finally delivered to the respective fuel injectors 98 through the fuel manifold 104 and the fuel rails 102 and injected to the combustion chambers 90 at certain timings and durations controlled by the ECU.

The air induction system 100 is provided, as noted above, for delivering an air charge to the sections 82 of the crankcase chamber 78 associated with each of the cylinder bores 66. This communication is via an air induction passage 108 formed in the crankcase member 80 and registered with each such crankcase chamber section 82. Because of this, the air induction passage 108 is divided into six intake ports 109 corresponding to the crankcase chamber section 82.

Air is, at first, introduced into interior of the top cowling 40 through a pair of air inlet compartments (not shown) disposed at the rear and uppermost portion of the cowling 40. Then, the air is introduced into the air induction system 100. The air induction system 100 includes an air silencing and inlet device 110. This air inlet device 110 is placed at the forward end of the engine 38 and has rearwardly facing air inlet opening 112 through which air is introduced.

The air inlet device 110 supplies the air to a plurality of throttle bodies 116, each of which has a throttle valve 118 provided therein as schematically shown in FIG. 2. These throttle valves 118 are supported on throttle valve shafts 120. These throttle valve shafts 120 are linked together by a linkage assembly 122 and are connected to a throttle lever on or near a steering handle (not shown) by a throttle cable for simultaneous opening and closing of the throttle valves 118. When the throttle valves 118 are almost fully opened, a great amount of air charge passes through the throttle bodies 116. Meanwhile, when the throttle valves 118 are almost fully closed, a relatively small air charge passes through it that can maintain an idling operation of the engine 38. The more the air charge amount increases, the faster the crankshaft 46 rotates. In other words, the rotational speed of the crankshaft 46 increases when the air charge amount increases, assuming the fuel charge amount is likewise increased appropriately.

As is also typical in two stroke engine practice, the intake ports 109 of the air induction passage 78 have, provided in them, reed-type check valves 124. The check valves 124 permit the air to flow into the sections 82 of the crankcase chamber 78 through the respective intake ports 109 when the pistons 68 are moving upwardly in their respective cylinder bores 66. However, as the pistons 68 move forward (i.e., toward the crankcase), the charge will be compressed in the sections 82 of the crankcase chamber 78. At that time, the reed-type check valves 124 will close so as to permit the charge to be compressed.

The charge which is compressed in the sections 82 is then transferred to the combustion chambers 90 through a scavenging system. The scavenging system is of the Schnurle type and includes scavenge ports 126. Scavenge passages 128 communicate the respective sections 82 of the crankcase chamber 78 with the scavenge ports 126. As is well known in a two stroke engine practice, the scavenge ports 126 are opened and closed by the reciprocation of the pistons 68 in the cylinder bores 66. When the scavenge ports 126 are opened, they place the combustion chambers 90 in communication with the respective sections 82 of the crankcase chamber 78. Thus, the air charge compressed in the crankcase chamber 78 rushes into the corresponding combustion chamber 90 when the scavenge ports 126 are opened.

After the air fuel charge has been injected into the combustion chambers 90, the air/fuel charge is fired by the spark plugs 94. The injection timing and duration by the fuel injectors 98 and also the timing of firing of the spark plugs 94 are controlled by the ECU.

Once the charge burns and expands, the pistons 68 is driven forward in the cylinder bores until the pistons 68 reach the lowermost position. At this time, an exhaust ports 130 will be uncovered so as to open to exhaust passages 132 formed in the cylinder block 62. The burnt charge or exhaust gasses flow through the exhaust passages 132 to manifold collector sections 134 of respective exhaust manifolds that are formed within the cylinder block 62. The manifold collector sections 134 communicate with an expansion chamber formed in the driveshaft housing 32. From the expansion chamber, the exhaust gasses are discharged to the atmosphere through the remainder sections of the exhaust system in the driveshaft housing 32, the lower unit 34 and the propeller hub 48.

Since conventional two stroke engines are well known in the art, a further description of them is not believed to be necessary to permit those skilled in the art to practice the invention.

With reference again to FIGS. 2 and 3 and additionally to FIGS. 4 through 10, a lubrication system in accordance with an embodiment of the present invention will be described. The lubrication system includes a lubricant supply tank 150 which is shown schematically in FIG. 2. A lubrication pump 152 is provided for spraying or otherwise introducing lubricant into the intake ports 109 initially for lubrication of the crankcase chamber 78 and eventually for lubrication of the entire engine. Although not seen in FIG. 3, the lubricant supply tank 150 is positioned higher than the lubrication pump 152. The lubrication pump has six outlet ports 154 corresponding to the six cylinder bores 66. This lubrication pump 152 is a mechanical type as will be described shortly. The pump, however, can have more or less ports than the engine has cylinders.

The outlet ports 154 of the lubrication pump 152 communicate the intake ports 109 of the air induction system 100 by supply conduits 156. The respective supply conduits 156 have injection ports 158 mounted on the port side wall 160 of the air induction passage 108 and opening to the respective intake ports 109 at each upper portion. The injection ports 158 are positioned immediately downstream of the reed valves 124 and project into the intake ports 108 with a certain length, for example, 10 mm. Lubricant is, thus, sprayed into the intake ports 108 through the injection ports 158 when the lubrication pump 152 is operated.

In the meantime, lubricant drains 162 (see FIG. 3) are provided at respective lowermost scavenge passages 128 at each cylinder bore 66. The lubricant drains 162 communicate the intake ports 109 of the air induction system 100 by means of return conduits 164. The respective return conduits 164 have return ports 166 mounted on the wall of the air induction passage 108. That is, the drains 162 for the first, third and fifth cylinder bores 66 from the top are connected to the return ports 166 positioned at the starboard side wall 168, while the drains 162 for the second, fourth and sixth cylinder bores 66 from the top are connected to the return ports 166 positioned at the port side wall 160. Each return port 166 is placed at an upper portion of each intake port 109. As best seen in FIG. 3, the lubricant drains 162 are not connected to the return ports 166 belonging to the same cylinder bores 66 but different bores 66. Also, although not seen in the figure, the respective return conduits 164 incorporate check valves for avoiding adverse flow. These drainage system is useful to return lubricant accumulated at the lowermost scavenge passages 128 to the crankcase chamber 78.

The lubrication pump 152 will now be described more in detail by reference primarily to FIGS. 4 and 5. Although, actually, the lubrication pump 152 is disposed generally vertically, it is laid horizontally in FIGS. 4 and 5. The left hand side, therefore, in these figures is actually the top of the lubrication pump 152.

The lubrication pump 152 is basically a plunger pump and includes a differential plunger 170 extending for axial or reciprocal movement in a bore 172 of a housing 174 of the pump 152. Both ends of the bore 172 are closed with closure members 175 and the closure members 175 are affixed to the housing 174 with screws 176. The plunger 170 comprises a drive section 177 and a pump section 178. The drive section 177 is generally configured as a drum-shaped gear and meshed with a worm gear 180 on a driveshaft 181 that is indirectly driven by a crankshaft 46. The drum shaped gear 177 is, thus, driven by the worm gear 180. When the worm gear 180 rotates in the direction as indicated with the arrow 182, the drum-shaped gear 176 rotates and simultaneously reciprocates as indicated by arrow 184. Since the drive section 177 and the pump section 178 are unified with each other, the pump section 178 also rotates and reciprocates with the drive section 177.

The pump section 178 is formed with a cavity 186 having a large diameter portion and a small diameter portion therein. A sub-plunger 188 is slidably disposed in the cavity 186. The sub-plunger 188 has a large diameter portion and a small diameter portion, each fitting in the corresponding cavity portions of the pump section 178. The outer end 196 of the sub-plunger 188 is supported by a spring retainer 198 that retains a coil spring 200 between the retainer 198 and an outer edge of the pump section 178. The spring retainer 198 contacts the inner surface of the closure member 175. The coil spring 200 can exert force upon the pump section 178 toward the right-hand direction in FIGS. 4 and 5. The movement of the pump section 178, i.e., plunger 170 per se in this direction, is limited by an adjustment mechanism 201 which will be described shortly.

The pump section 178 also has an inlet delivery paths 202 and outlet delivery paths 204. The inlet delivery paths 202 can communicate to inlet passages 206 formed in the housing 174 when they overlap each other by the rotation of the pump section 178, while the outlet delivery paths 204 can communicate to outlet passages 208 therein also when they overlap each other. Although not shown, each one of the inlet delivery paths 204 and each one of the outlet delivery paths 204 communicate with each other in the pump section 178. Also, the respective inlet and outlet passages 26, 208 may have check valves therein for preventing the lubricant from adversely flowing backwards.

The inlet and outlet delivery paths 202, 204 communicate with the cavity 186. The sub-plunger 188 axially moves in the cavity 186 along with the reciprocal movement of the pump section 178 with a lost motion caused by the spring 200. This is a pumping action. Thus, the lubricant that has entered the inlet delivery paths 202 is pushed out to the outlet passages 208 through the outlet paths 204.

Each overlap area defined by each pair of the delivery paths 202, 204 and passages 206, 208 can be changed by the reciprocal movement of the pump section 178. In other words, a volume of lubrication pumped out from the pump section 178 is measured by an amount of the reciprocal movement of the pump section 178.

The inlet passages 206 communicate with an inlet conduit 210 that is affixed at an inlet opening 212 of the housing 174 in a suitable manner. The outlet passages 208 communicate with the supply conduits 156 at the outlet ports 154. Six outlet passages 208 are provided and lubricant is supplied to respective cylinder bores 66 through the supply conduits 156 as noted above. Actually, the inlet passages 206 and the outlet passages 208 are positioned generally normal to each other in the housing 174, while the inlet delivery paths 202 and the outlet delivery paths 204 are positioned on the opposite sides relative to each other in the pump section 178.

The adjustment mechanism 201 is provided for adjusting the amount of the reciprocal movement of the plunger 170 that has the pump section 178. The adjustment mechanism 201 includes a control shaft or rotary member 222 journaled in a bore 224 formed in the housing 174 with a seal member 226. The control shaft 222 is connected to a coupling member 230 (see FIGS. 2 and 3) by means of a switchover connection 232, which will be described shortly. The coupling member 230, in turn, is connected to one of the throttle valve shaft 120 by means of a lever member 234. Linkage members 235 link all of the throttle valve shafts 120 together so that they move all together. The control shaft 222, therefore, rotates with the pivotal movement of the throttle valve shaft 120. Since the throttle valve shaft 120 rotates in response to rotational speed of the crankshaft 46, eventually the control shaft 222 also rotates in following the rotational speed of the crankshaft 46.

Figure 4:
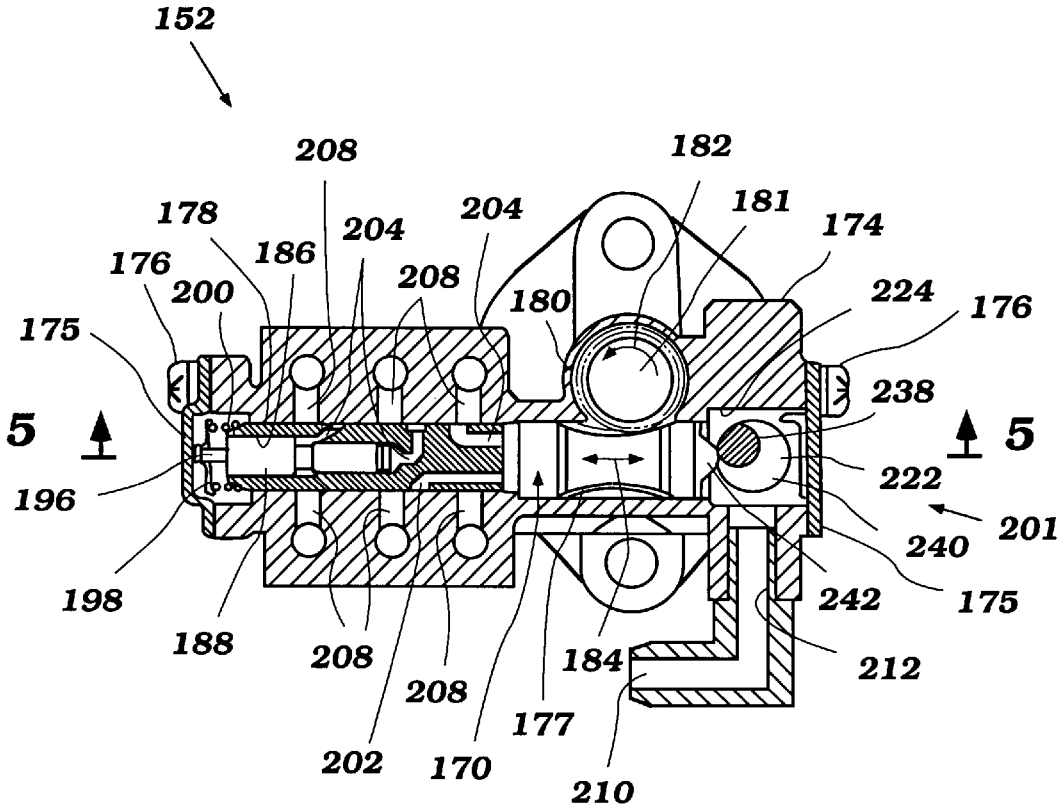
FIG. 4 is an enlarged cross-sectional view showing an lubrication pump employed in the engine and taken along the line 4—4 in FIG. 5. Arrangements including paths and passages are somewhat schematically indicated.
Figure 5:
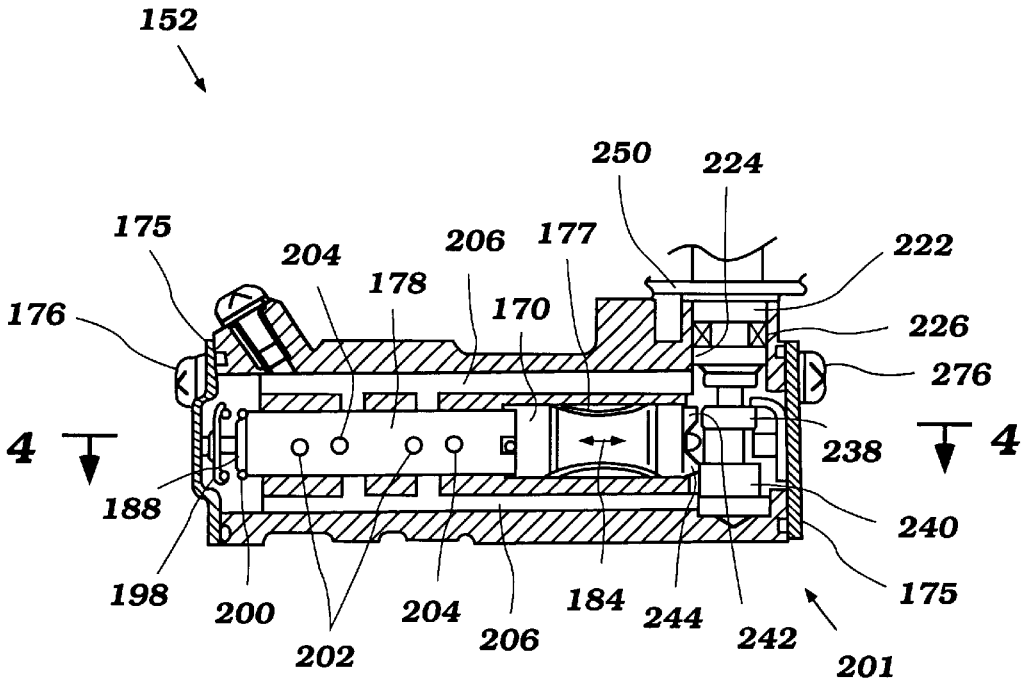
FIG. 5 is an enlarged cross-sectional view showing the lubrication pump taken along the line 5—5 in FIG. 4. The arrangements including paths and passages are also schematically indicated.
Figure 6:
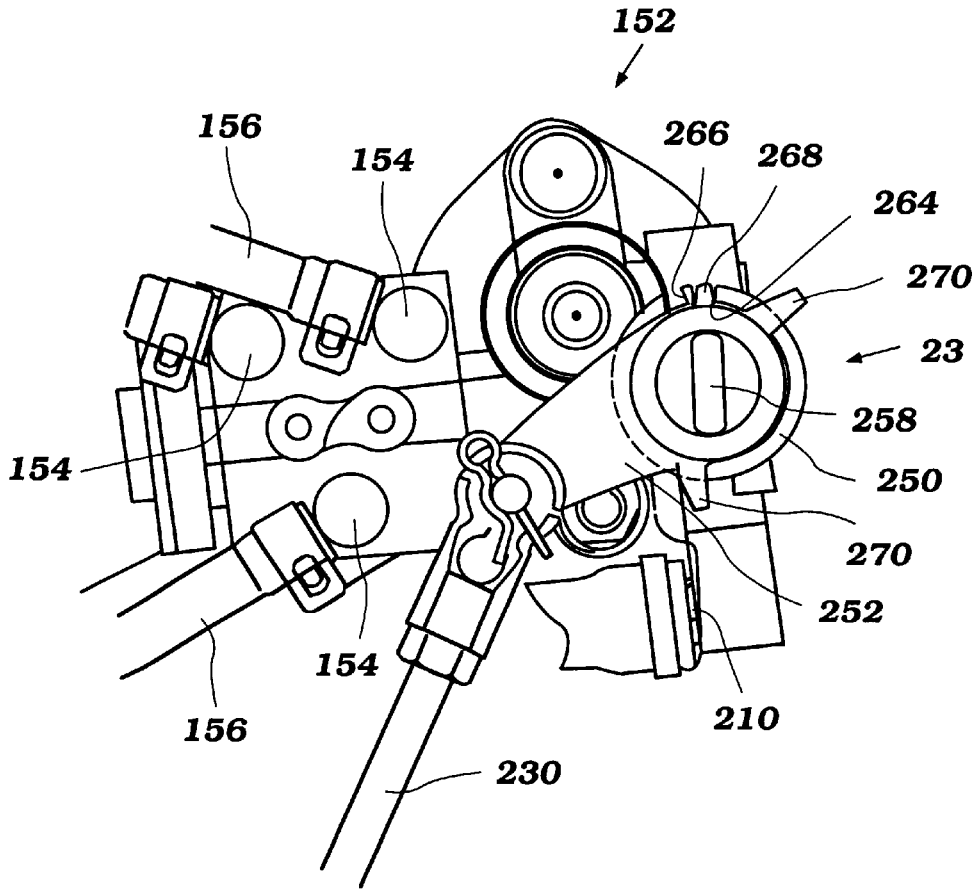
FIG. 6 is an enlarged plan view partially showing the lubrication pump in a state in which the control lever is engaged with a selector member at a regular position.

As seen in FIGS. 4 and 5, the control shaft 222 has two cam lobes 238, 240 provided within the bore 224. These cam lobes 238, 240 are generally formed with off-centered circles. One of the cam lobes 238 has a diameter of its base circle smaller than a diameter of its base circle of the other cam lobe 240. Meanwhile, the drive section 177 has two projections 242, 244 and the cam lobes 238, 240 selectively contacts each one of the projection 242, 244. That is, when the small cam lobe 238 contacts the projection 242, the large cam lobe 240 does not contacts the other projection 244, and when the large cam lobe 240 contacts the projection 244, the small cam lobe 238 does not contact the projection 242. In addition, the eccentricity of the small cam lobe 238 is greater than the eccentricity of the large cam lobe 240. Thus, the axial movement of the plunger 170 towards the right hand direction in FIGS. 4 and 5 is limited by either one of the small cam lobe 238 or the large cam lobe 240 selectively.

The switchover connection 232 will be described with primarily reference to FIGS. 6 through 11. The switchover connection 232 includes a selector member 250 affixed on the control shaft 222 and a control lever 252 connected to the coupling member 230 in a suitable manner. The control lever 252 is put on the control shaft 222 and is urged toward the selector member 250 by a coil spring 254 positioned between the control lever 252 and a spring retainer 256. The spring retainer 256 is rigidly affixed on the control shaft 222. The control lever 252 has a knob 258 affixed thereon with a screw connection 260. The control lever 252 together with the coupling member 230 and the lever member 234 define a control assembly 269 (FIG. 2).

Figure 7:
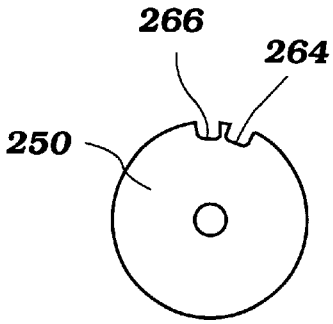
FIG. 7 is a plan view showing the selector member of FIG. 6.
Figure 8:
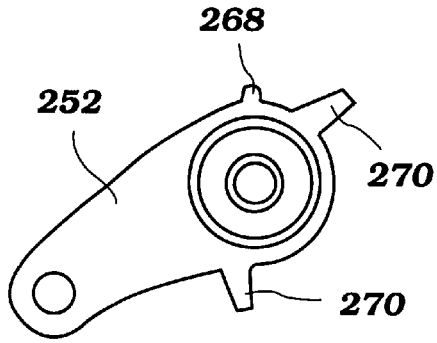
FIG. 8 is a plan view showing the control lever of FIG. 6.
Figure 9:
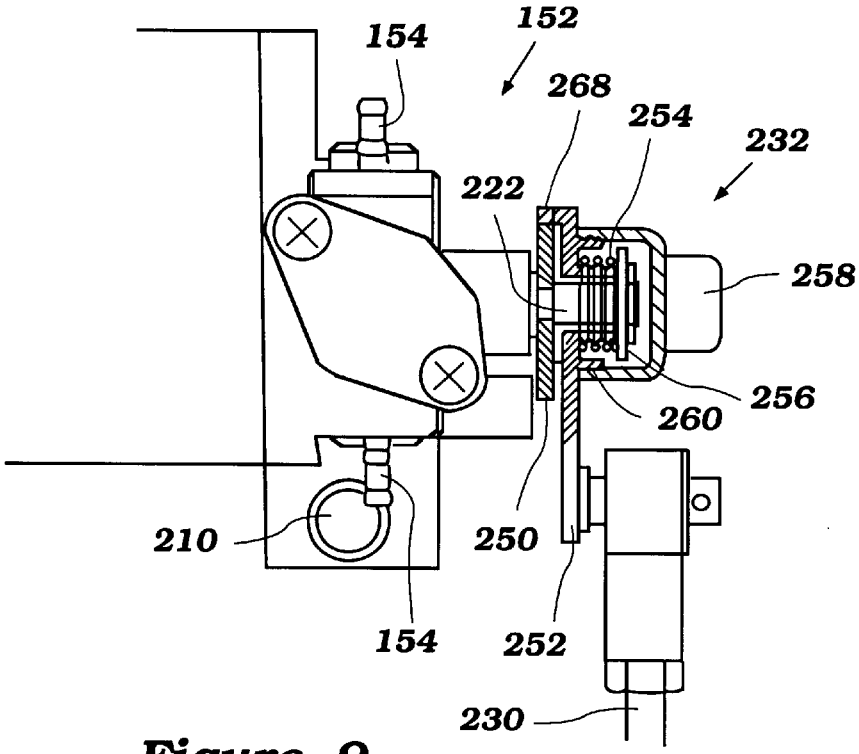
FIG. 9 is a schematic side elevational view showing the lubrication pump and partially in cross-section.
Figure 10:
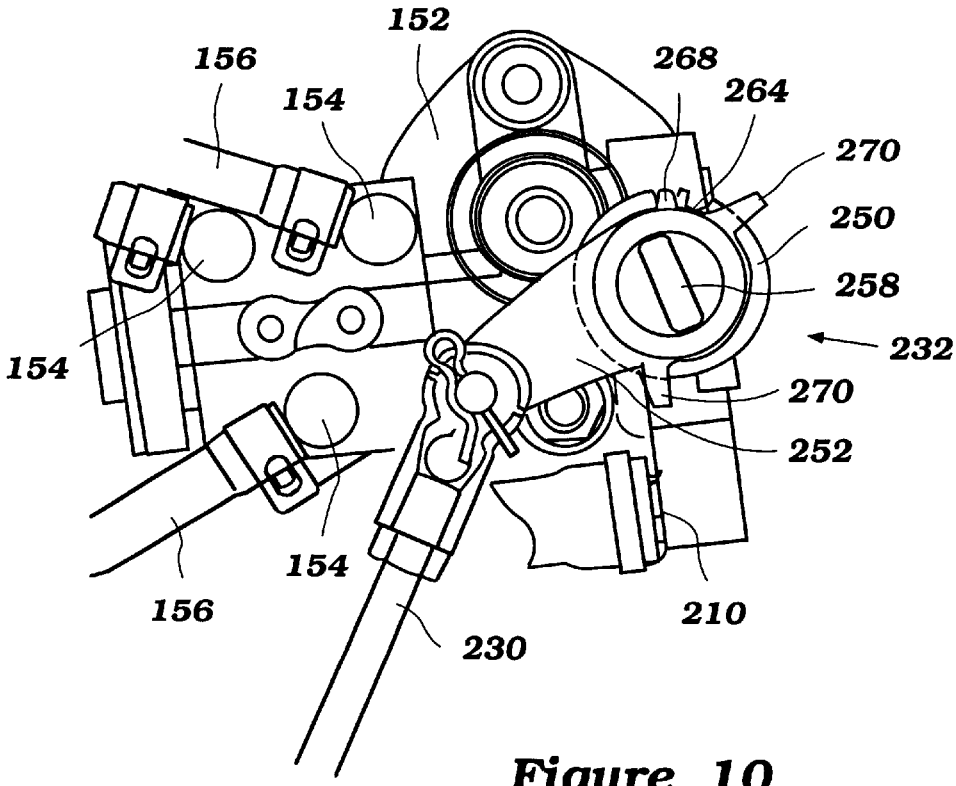
FIG. 10 is an enlarged plan view partially showing the lubrication pump in a state in which a control lever is engaged with the selector member at an increase position.

As best seen in FIGS. 7 and 8, the selector member 250 has a pair of notches 264, 266 adjoining each other. Meanwhile, the control lever 252 has a projection 268. The projection 268 of the control lever 252 can be selectively engaged with one notch 264 or the other notch 266. The human operator can make this selection. That is, usually or in regular operation of lubrication, the first notch 264 is selected. When the operator desires to supply greater lubricant than the regular operation, the operator takes the knob 258 with his or her fingers and puts the projection into the notch 266. By this action, the angle of the control lever 252 relative to the selector member 250, eventually relative to the control shaft 222, is changed. The control lever 252 additionally is securely affixed to the selector member 250 by the spring 254 which urges the control lever 252 toward the selector member 250. Once it is affixed thereon, the selected angle relative to the control shaft 222 can be maintained.

The control lever 252 has a pair of additional projections 270 spaced apart to each other. These projections 270 contact portions (not shown) on the housing 174 of the lubrication pump 152 to limit a range of the movement of the control lever 252.

As understood from FIGS. 4 through 11, in an operation of the lubrication pump 152, all cavities of the lubrication pump 152 including the inlet conduit 210, the bore 224 and the inlet passages 206 are previously filled with lubricant because of the head difference between the lubricant supply tank 150 and the lubrication pump 152. The plunger 170 is driven by the crankshaft 46 and rotates and reciprocates. Lubricant is hence continuously drawn through the inlet conduit 210 into the inlet passages 206 and enters the inlet delivery paths 202. The lubricant is, then, pushed to the outlet passages 208 through the outlet delivery paths 204 by the pumping operation of the plunger 170 including the sub-plunger 188 forced by the spring 200.

In this pumping action, a volume of the lubricant per motion is measured with the area at which the respective outlet delivery paths 204 and the outlet passages 208 are overlapped. As described above, an amount of the overlap is regulated by the cam configuration of the control shaft 222 in the adjustment mechanism 201. In other words, the selection of either the small cam lobe 238 or the large cam lobe 240 as well as the rotation angle of the control shaft 222 (the angle of the control lever 252) linked together with the throttle valve shafts 120 change the overlap amount.

In addition, the pumping speed, i.e., the speed of the reciprocal movement of the plunger 170, is in proportion to the rotational speed of the driveshaft 181. The rotational speed of the driveshaft 181 is, in turn, proportion to the rotational speed of the crankshaft 46. Accordingly, the faster the crankshaft 46 rotates, the greater the volume of the lubricant increases.

Figure 11:
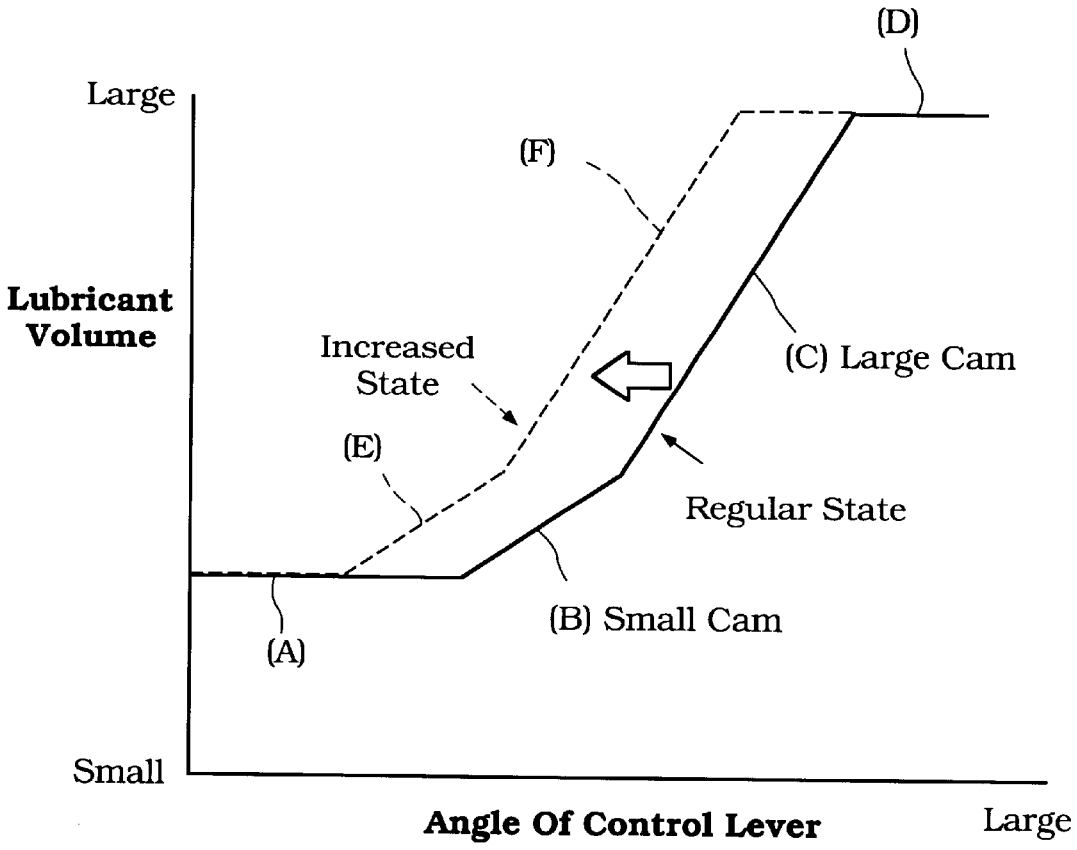
FIG. 11 is a graph showing the relationship between angles of the control lever and volumes of lubricant delivered by the lubrication pump.

In FIG. 11, the horizontal axis indicates the angles of the control lever 252, while the vertical axis indicates the delivery volumes of the lubricant. If the engine 38 needs regular volume of lubricant, the operator selects the regular position of the switchover connection 232 with the knob 258 as noted above. More specifically, by turning the knob 258, the operator puts the projection 268 of the control lever 252 in the notch 264 of the selector member 250. Regular volume of the lubricant is, thus, measured along the solid lines (A), (B), (C) and (D).

The line starts from a relatively small volume of the lubricant and goes on the same level of the delivery volume until the control lever 252 reaches an certain angle as indicated with the line (A). Because neither the small cam lobe 238 nor the large cam lobe 240 engages with the one of the projections 242, 244 of the plunger drive section 177. With the pivotal movement of the control lever 252 in response to the pivotal movement of the throttle shaft 120, the small cam lobe 238 engages the projection 244 and the lubricant volume starts increasing as indicated with the line (B). Then, the small cam lobe 238 disengages the projection 244 and the large cam lobe 240 is, in turn, engages the projection 242. The lubricant volume continues to increase as shown with the line (C). When the control lever 252 reaches another certain angle, which is larger than the former angle, the large cam lobe 240 disengages the projection 242 and hence the lubricant volume no longer increases as shown with the line (D).

If the projection 268 of the control lever 252 is moved from the regular position and fitted into the other notch 266 of the selector member 250 to establish the increase position, greater volume of the lubricant is measured along the dotted line. That is, the solid lines (A), (B), (C) and (D) are translated to the left-hand side in the graph. With the pivotal movement of the control lever 252, therefore, the volume of the lubricant increases along the lines (A), (E), (F) and (D) at this time.

As described above, the lubricant volume can be easily changed by selecting one of the notches 264, 266 of the selector member 250, which engages the projection 268 of the control lever 252. This is particularly advantageous for a mechanical pump because only a few members such as the selector member 250, spring 254 and knob 258 are required and then merely some machining or pressing of sheet metals and assembling are necessary.

With reference to FIGS. 12 through 17, another embodiment of the switchover connection will be described. The same members and components already described with reference to FIGS. 1 through 11 will be assigned with the same reference numerals and will not be described again for avoiding redundancy.

Figure 12:
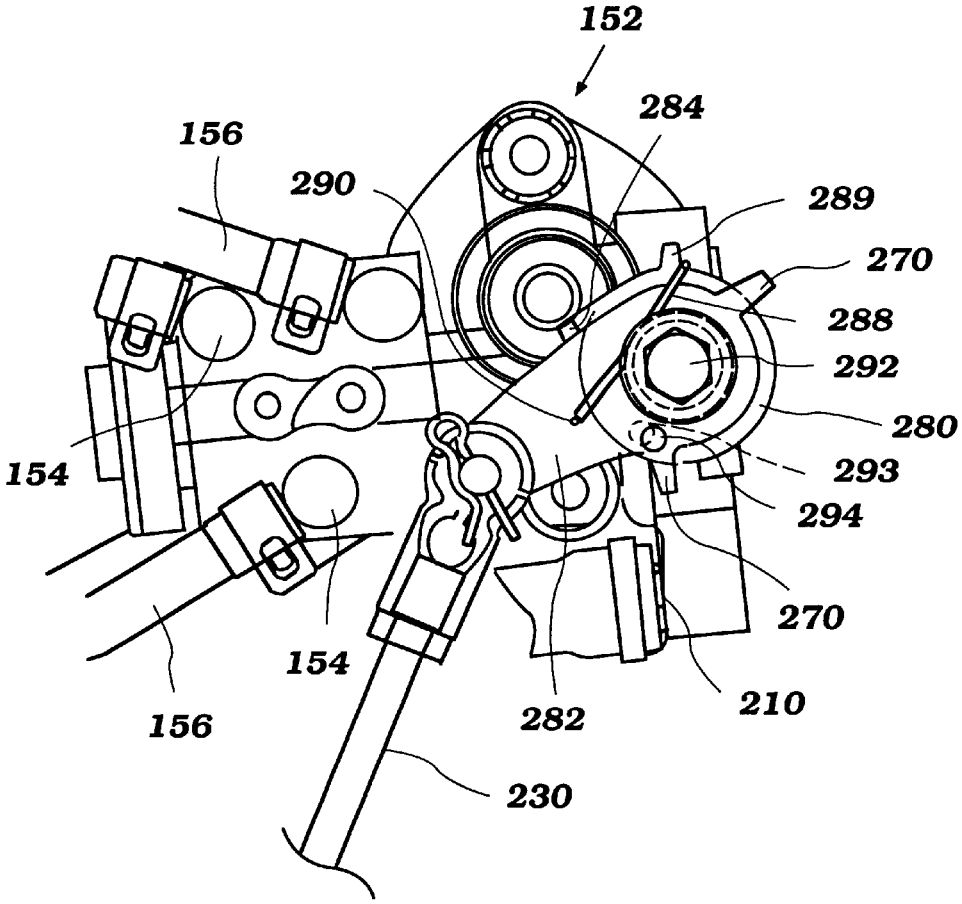
FIG. 12 is an enlarged plan view partially showing another embodiment of the lubrication pump in a state in which a control lever is engaged with a selector member at a regular position.
Figure 13:
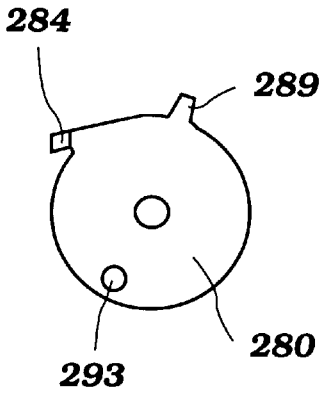
FIG. 13 is a plan view showing the selector member of FIG. 12.
Figure 14:
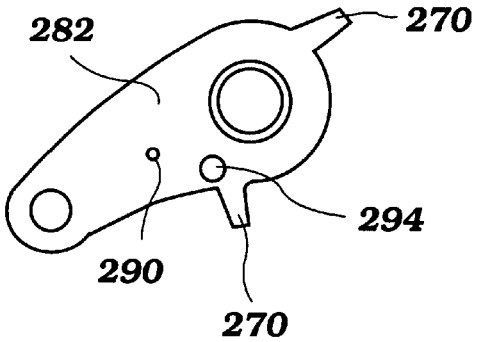
FIG. 14 is a plan view showing the control lever of FIG. 12.
Figure 15:
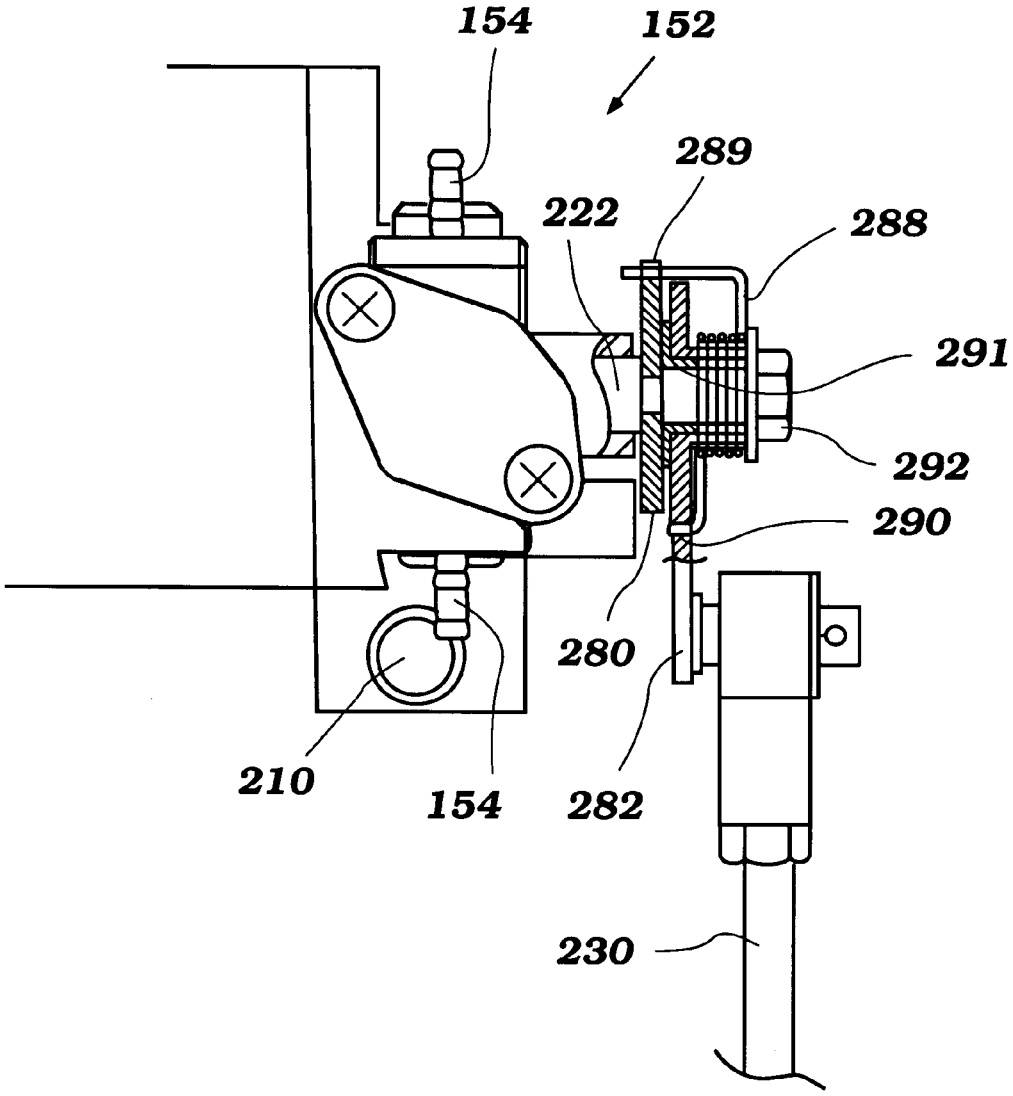
FIG. 15 is a schematic, partial sectional, side view showing the lubrication pump of FIG. 12.
Figure 17:
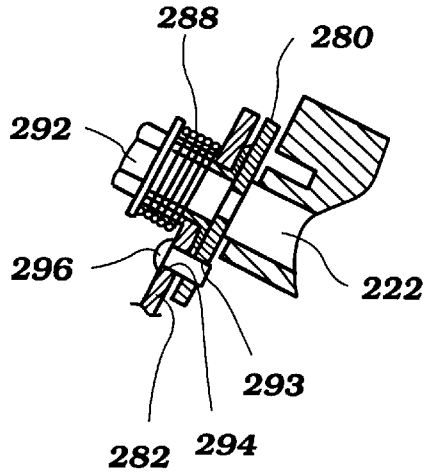
FIG. 17 is an enlarged cross-sectional view showing a pin fitted in apertures of the selector member and the control lever to maintain these components at the increase position illustrated in FIG. 16.

The switchover connection 232 in this embodiment includes another selector member 280 and another control lever 282 connected to the coupling member 230 in a suitable manner. The control lever 282 is pivotally affixed on the control shaft 222. The selector member 280 has a projection 284 and a coil spring 288 is provided for urging the selector member 280 so that the projection 284 engages with the outer edge of the control lever 282. That is, one end of the coil spring 288 is fitted into an aperture 290 and the other end is engaged with another projection 289 of the selector member 280 and the other end tackles the projection 289 to exert force upon the selector member 280 anti-clockwise as shown in FIGS. 12 and 17. An intermediate member 291 is provided between the selector member 280 and the control lever 282. Both of the selector member 280 and the control lever 282 are affixed on the control shaft 222 by a bolt 292 and they have apertures 293, 294, respectively, thereon. As seen FIG. 12, these apertures 293, 294 have axes which are inconsistent with each other. When the control lever 282 is positioned in this state, the switchover connection 232 is situated for supplying regular volume of lubricant that corresponds to the lines (A), (B), (C) and (D) in FIG. 11.

Figure 16:
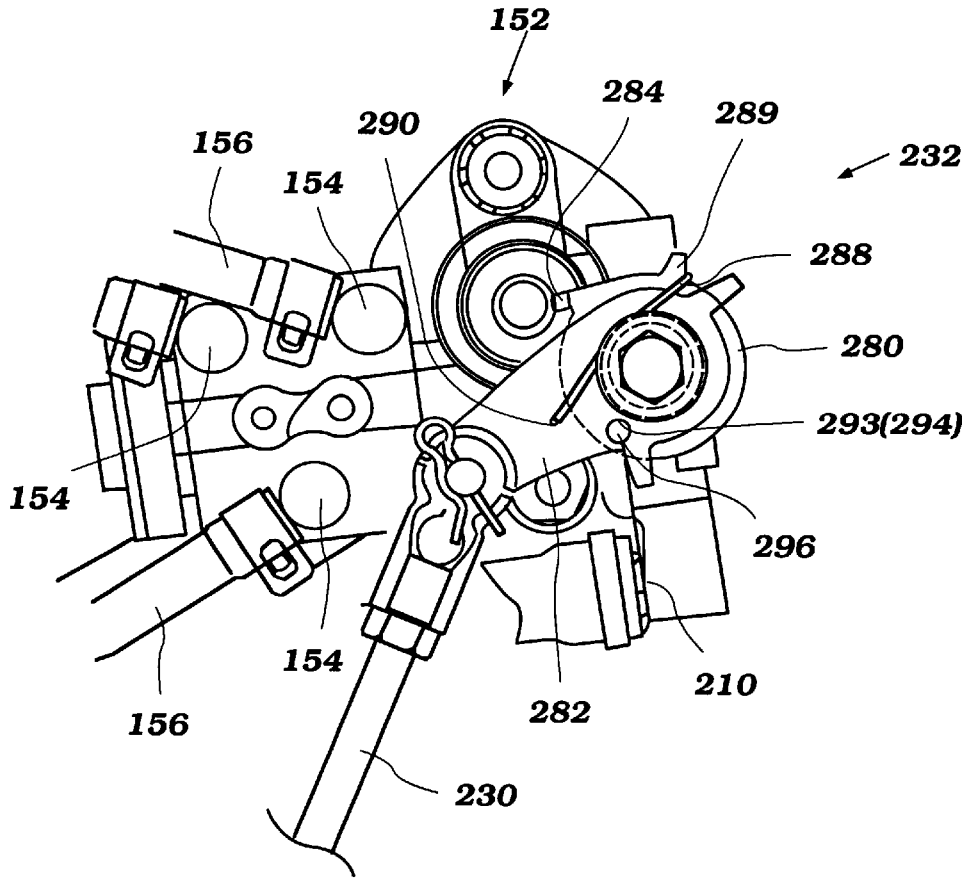
FIG. 16 is an enlarged plan view partially showing the lubrication pump of FIG. 12 in a state in which the control lever is engaged with the selector member at an increase position.

As seen in FIGS. 16 and 17, when a pin 296 is fitted into both of the apertures 293, 294 so as to unite their axes, the projection 284 is kept apart from the edge of the control lever 282 against the urging force by the spring 288. When the control lever 282 is positioned in this state, the switchover connection 232 is situated for supplying greater volume of lubricant than the regular situation and this corresponds to the lines (A), (E), (F) and (D) in FIG. 11.

Before the outboard motor 20 is shipped out from a factory, for instance, the pin 296 is fitted into the both apertures 293, 294 so that the switchover connection 232 is in the position where lubricant is increased (see FIGS. 16 and 17). The outboard motor 20 is operated under this condition during a time necessary to break-in the motor, (e.g., about ten hours). After the break-in period, the user removes the pin 296 from the apertures 293, 294. The spring 288, then, urges the selector member 280 toward the engaged position of the projection 284 with the edge of the control lever 282. Thus, the switchover connection 232 is brought into the position where lubricant is decreased to a desired volume for regular operation (see FIG. 11).

This embodiment does not require any knob. In addition, the selector member 280 and the control lever 282 can be made with easy machining or pressing of sheet metals in a similar manner of making the selector member 250 and the control lever 252 for the first embodiment.

It should be noted that the injection ports 158 can be formed internally at wall portions of the crankcase member 80. The notches 264, 266 formed on the selector member 250 can be provided on the control lever 252 and conversely the projection 268 on the control lever 252 can be made on the selector member 250. Also, the notches 264, 266 can be replaced with apertures.

The control shaft 222 may have configurations other than the eccentric circular cam lobes if the same function can be achieved. Also, the small and large cams 238, 240 can be replaced with a single cam.

The selector member 250, 280 is dispensable. That is, for example, the control shaft 222 per se can have the same configuration as the selector member 250, 280 thereon.

Also, the switchover connection 232 can be used not only for the accustomed operation but also for other operations in which the engine 38 requires much lubricant than the regular situation due to, for example, used under the extremely rigorous circumstances.

The engine may have other fuel supply system other than the direct injection.

Also, the engine embodied with the features of the present invention can be applied not only for outboard motors but also for, for example, inboard/outdrives, personal watercrafts, automobiles, motorcycles, snowmobiles, lawn mowers and generators.

Of course, the foregoing description is that of preferred embodiments of the invention, and various changes and modifications may be made without departing from the spirit and scope of the invention, as defined by the appended claims.

What is claimed is:

1. An internal combustion engine comprising a cylinder body defining at least one cylinder bore in which a piston reciprocates, said cylinder bore having a closed end, said closed end defining with said piston and said cylinder bore a combustion chamber, an air induction device configured to supply a volume of air to said combustion chamber when in a first position, said air induction device including an air amount control mechanism configured to adjust the volume of air, and a lubrication device configured to deliver a volume of lubricant to a portion of said engine, said lubrication device including a lubricant amount control mechanism configured to adjust the volume of lubricant in an amount corresponding to the volume of air adjusted by said air amount control mechanism, and a user selectable switchover mechanism connecting the air induction device with the lubricant control amount mechanism and being configured to change the volume of lubricant delivered to the portion of said engine at a particular volume of air, the switchover mechanism having at least first and second positions, the lubrication device delivering a first volume of lubricant to the portion of said engine when the air induction device is in the first position and with the switchover mechanism in the first position, and delivering a second larger volume of lubricant to the portion of said engine with the air induction device in the second position and with the switchover mechanism in the second position.

2. An internal combustion engine as set forth in claim 1, wherein said lubrication device includes a pumping assembly, and said lubricant amount control mechanism adjusts the lubricant volume delivered from said pumping assembly.

3. An internal combustion engine as set forth in claim 2, wherein said pumping assembly is configured to meter the lubricant volume by axial movement, said lubricant amount control mechanism being configured to adjust an amount of the axial movement.

4. An internal combustion engine as set forth in claim 3, wherein said pumping assembly includes an axially movable member, said lubricant amount control mechanism includes a rotary member having at least one cam configuration disposed transversely relative to the axis of rotation, and said rotary member is engaged with said axially movable member at the cam configuration.

5. An internal combustion engine as set forth in claim 4, wherein said switchover mechanism further includes means for selectively fixing a rotational angle of said rotary member at one of said positions.

6. An internal combustion engine as set forth in claim 5, wherein said switchover mechanism further includes a control assembly rotating said rotary member ill following said air amount control mechanism, both of said control assembly and said rotary member have at least two engageable positions, and both of said control assembly and said rotary member are selectively engaged with each other at one of said engageable positions.

7. An internal combustion engine as set forth in claim 6, wherein said rotary member has at least two engage portions, and said control assembly has an engage section being engageable with one of said engage portions.

8. An internal combustion engine as set forth in claim 7, wherein said engage portions of said rotary member include notches and said engage section of said control assembly includes an projection.

9. An internal combustion engine as set forth in claim 5, wherein said switchover mechanism further includes a control assembly rotating said rotary member in following said air amount control mechanism, an engagement member engaging said control assembly with said rotary member, and a position change mechanism changing positions of said control assembly and said rotary member relative to each other.

10. An internal combustion engine as set forth in claim 9, wherein said position change mechanism includes apertures disposed at both of said control assembly and said rotary member and a pin being capable to be fitted into both of said apertures, and said apertures are slipped off relative to each other without said pin.

11. An internal combustion engine as set forth in claim 9, wherein said engagement member includes a spring.

12. An internal combustion engine as set forth in claim 1, wherein said switchover mechanism is selectively fixed at one of the positions.

13. An internal combustion engine as set forth in claim 12, wherein said switchover mechanism includes at least two members being movable relative to each other.

14. An internal combustion engine as set forth in claim 1, wherein said air amount control mechanism includes a throttle valve and said switchover mechanism is linked with said throttle valve.

15. An internal combustion engine as set forth in claim 1, wherein said engine operates on a two stroke crankcase compression principle.

16. An internal combustion engine as set forth in claim 1, wherein said engine further comprising a fuel injector directly spraying fuel into said combustion chamber.

17. An internal combustion engine as set forth in claim 1 additionally comprising a crankcase member adjoining said cylinder block and defining a crankcase chamber in which a crankshaft rotating with the reciprocal movement of said piston, wherein said lubrication device delivers the lubricant to said crankcase chamber.

18. An internal combustion engine as set forth in claim 17 additionally comprising a fuel injector configured to directly spray fuel into said combustion chamber.

19. An internal combustion engine as set forth in claim 18, wherein the engine is configured to operate on a two stroke crankcase compression principle.

20. An internal combustion engine as set forth in claim 1, wherein said engine powers a marine propulsion device.

21. An internal combustion engine comprising a cylinder body defining at least one cylinder bore in which a piston reciprocates, said cylinder bore having a closed end and an open end, said closed end defining with said piston and said cylinder bore a combustion chamber, a crankcase adjoining said cylinder block and defining a crankcase chamber with said open end, said crankcase chamber accommodating a crankshaft pivotally coupled to said piston and rotating within the crankcase, an air intake system supplying an air charge to said combustion chamber, said air intake system including a throttle valve controlling an amount of the air charge, said engine further comprising a lubrication pump delivering lubricant to said crankcase chamber, said lubrication pump including a rotary member which changes an amount of lubricant flow through the lubrication pump when the rotary member is rotated, a control lever linked with said throttle valve and selectively mounted on said rotary member at least in two positions, and a switchover mechanism changing said position of said control lever relative to said rotary member.

22. An internal combustion engine as set forth in claim 21, wherein the amount of the lubricant delivered by said lubrication pump when said control lever is positioned at one of said positions is greater than when the control lever is positioned at the other position.

23. An internal combustion engine as set forth in claim 22, wherein said control lever is fixed at one of said positions mechanically.

24. An internal combustion engine comprising a cylinder body defining at least one cylinder bore in which a piston reciprocates, said cylinder bore having a closed end, said closed end defining with said piston and said cylinder bore a combustion chamber, an air induction device supplying a volume of air to said combustion chamber, means for adjusting the volume of air, a lubrication device delivering a volume of lubricant to a portion of said engine in an amount corresponding to the volume of air adjusted by said means for adjusting the volume of air, and means for adjusting the volume of lubricant delivered to the portion of said engine at a particular volume of air go as to increase the amount of lubricant delivered to the portion of said engine during a break-in period of the engine and to decrease the amount of lubricant delivered to the portion of said engine after the break-in period, wherein the means for adjusting the volume of lubricant comprises a mechanical connection between the means for adjusting the volume of air and the lubrication device.

25. An internal combustion engine as set forth in claim 24, wherein the adjusting means includes at least two members arranged to engage with one another selectively at a first physically fixed position and a second physically fixed position both corresponding to the same particular volume of air, and the amount of lubricant is increased at the first fixed position and decreased at the second fixed position.

26. An internal combustion engine comprising a cylinder body defining a cylinder bore, a piston reciprocating within the cylinder bore, a cylinder head defining a combustion chamber together with the piston and the cylinder bore, an air induction system supplying air to the combustion chamber, the air induction system including a throttle valve arranged to control an amount of the air, a lubrication pump arranged to deliver lubricant to a portion of the engine, the lubrication pump including a rotary member arranged to change an amount of the lubricant, a control lever linked with the throttle valve and selectively mounted on the rotary member at least in two positions, and a switchover mechanism arranged to change the positions of the control lever relative to the rotary member.

27. An internal combustion engine as set forth in claim 26, wherein a first amount of the lubricant delivered by the lubrication pump when the control lever is positioned at one of the positions is greater than a second amount of the lubricant delivered by the lubrication pump when the control lever is positioned at another position.

28. An internal combustion engine as set forth in claim 27, wherein the control lever is fixed at one of the positions physically.

29. An internal combustion engine comprising a cylinder body defining a cylinder bore, a piston reciprocating within the cylinder bore, a cylinder head defining a combustion chamber together with the cylinder bore and the piston, a lubricant pump arranged to deliver a volume of lubricant to a portion of the engine, an air induction device supplying a volume of air to said combustion chamber, said air induction device including an air amount measurement section to measure the volume of air, and a lubricant pump delivering a volume of lubricant to a portion of the engine, the lubricant pump including a pumping section and a control section arranged to control the pumping section so that the volume of lubricant is measured in an amount corresponding to a position of the air induction device, and a user selectable change mechanism arranged to change the control section at least between first and second states, wherein the control section controls the pumping section to deliver a first volume of lubricant at a particular volume of air in the first state, and the control section controls the pumping section to deliver a second larger volume of lubricant at the same particular volume of air in the second state.

30. An internal combustion engine comprising an engine body, a member moveable relative to the engine body, the engine body and the moveable member together defining a combustion chamber, an air intake system arranged to supply air to the combustion chamber, the air intake system including an air amount control unit, and a lubrication system arranged to deliver lubricant to the engine body, the lubrication system including a moveable adjustment member arranged to adjust an amount of the lubricant when moved, a control member linked with the air amount control unit and selectively engaging with the adjustment member at least in two positions, and a changeover mechanism arranged to change the positions of the control member relative to the adjustment member.

* * * * *